US005241829A

United States Patent [19]

Irie et al.

[11] Patent Number: 5,241,829

[45] Date of Patent: Sep. 7, 1993

[54] METHOD OF OPERATING HEAT PUMP

[75] Inventors: Toshimasa Irie, Neyagawa; Tohru Isoda, Takarazuka; Shuhei Miyauchi, Izumisano; Taizo Imoto, Higashi-osaka; Yukio Fujishima; Yasuhiro Hatano, both of Sakai; Masami Ogata, Hirakata; Yukitoshi Hatano, Takatsuki; Tamotsu Ishikawa, Kyoto Prefecture; Masayuki Kawabata, Hirakata, all of Japan

[73] Assignees: Osaka Prefecture Government; Nishiyodo Air Conditioner Co., Ltd., both of Osaka, Japan

[21] Appl. No.: 849,765

[22] Filed: Mar. 12, 1992

Related U.S. Application Data

[63] Continuation-in-part of Ser. No. 563,052, Aug. 6, 1990, abandoned.

[30] Foreign Application Priority Data

Nov. 2, 1989 [JP] Japan ..... 1-28673

[51] Int. Cl.[5] ..... F25B 7/00

[52] U.S. Cl. ..... 62/79; 62/98; 62/238.6; 62/204; 62/506

[58] Field of Search ..... 62/98, 335, 238.7, 238.6, 62/204, 506, 79, 175, 513, 113

[56] References Cited

U.S. PATENT DOCUMENTS 4,796,437 1/1989 James ..... 62/238.6 X

FOREIGN PATENT DOCUMENTS 2633100 2/1978 Fed. Rep. of Germany ..... 62/238.6

*Primary Examiner*—John M. Sollecito

*Attorney, Agent, or Firm*—Flynn, Thiel, Boutell & Tanis

[57] ABSTRACT

A method of operating a heat pump having at least one circuit for circulation of a refrigerant comprising a compressor, a once-through path, complete counter-flow type condenser as a high-temperature heat output means, an expansion valve and a low-temperature heat output means (evaporator or a segregated low-stage circuit for circulation of a lower-boiling-point refrigerant), which comprises choosing a supercool degree, which is equal to the difference between a saturation temperature and an outlet temperature of the refrigerant, to satisfy the conditions that a temperature effectiveness of refrigerant liquid as defined by the formula:

$$\text{temp. effectiveness} = \frac{\text{supercool degree}}{(\text{saturated refrigerant temp.} - \text{inlet temp. of fluid to be heated})}$$

is at least 40% and the temperature difference of the denominator is at least 35° C. As a result, boiling water of ca. 100° C. or other high-temperature fluids can be discharged with a large temperature difference.

4 Claims, 5 Drawing Sheets

METHOD OF OPERATING HEAT PUMP

CROSS-REFERENCE TO RELATED APPLICATION

This is a continuation-in-part application of the original U.S. application Ser. No. 07/563052 filed Aug. 6, 1990, now abandoned.

BACKGROUND OF THE INVENTION

1. Field of the Invention

This invention relates to a method of operating a heat pump for the purpose of acquiring a high-temperature fluid that is a high quality fluid, such as steam, boiling water, etc. More particularly, this invention provides a method of operating a heat pump characterized by utilizing effectively a subcool region of a condenser.

2. Prior Art

Heat pumps are utilized in a wide variety of applications for heat or cold, for example, refrigeration systems, space cooling or heating systems, hot water heating, etc.

High temperature heat such as heat of steam or boiling water is a high quality energy since storage of such heat is enabled with a high density, an installation (e.g. room heater) for the receipt of heat can be miniaturized, radiant space heating that is silent and moderate is possible, its application range is significantly enlarged because of its sterilizing ability, drying ability, cleaning ability, etc. Consequently, a technology of acquiring heat of such a high temperature efficiently with a heat pump is earnestly expected from many fields.

A major problem with heat pumps is that it is difficult to obtain heat of a high temperature and consequently, how we can attain a highest possible output temperature has been a matter of great concern. Many attempts have been made to that end, but a high temperature on the order of 70°-80° C. at the utmost has been attained.

Attempts to attain such a high temperature include, for example, a method of collecting selectively and efficiently super heat of condensers which are each of a counterflow, single path type (Brit. Patent No. 1 559 318), or a heat pump system comprising counterflow type multiple condensers operating at different multiple pressure levels and multiple expansion means (WO 83/04088). These known methods are aimed at high temperature of 160°-200° F. (ca. 71°-93° C.), but actually acquired is heat of 180° F.(82° C.) at maximum while cold is rejected.

Thus, it has not been possible, so far, to obtain a high-temperature fluid elevated to 100° C. such as boiling water or steam.

A general heat pump having a single circuit shown in FIG. 1*b* and its operation will be described with reference to FIG. 5*a* and FIG. 5*b*:

In an evaporator 4, refrigerant is evaporated at a definite temperature, extracting heat (from fluid to be cooled). When the evaporation is finished (e-f), dry saturated vapor is sucked and compressed with a compressor 1 and delivered at elevated pressure and temperature into a condenser 2 (f-a). The refrigerant vapor at an inlet of the condenser 2 is in superheated state and when a saturated vapor temperature is reached (a-b), liquefaction and condensation begin. The refrigerant is liquefied and condensed as it is cooled by a fluid to be heated (cooling water) until the refrigerant becomes saturated liquid and the condensation is completed (b-c). The liquid refrigerant is further subcooled (c-d) and passed through an expansion valve 3, and thereafter flows back into the evaporator 4 at lowered pressure and temperature (d-e). Thus, a refrigeration cycle is formed, wherein in the evaporator 4 the fluid to be cooled is changed into cold fluid giving up heat to the refrigerant whereas in the condenser 2 the fluid to be heated is changed into hot fluid extracting heat from the refrigerant. The enthalpy change during the refrigeration cycle is shown in a Mollier chart of FIG. 5*b* and the heat exchange between the refrigerant and the fluid in the condenser is shown in FIG. 5*a*.

The heat pump operation is also true with a binary heat pump illustrated in FIG. 1*a*, which comprises a low-temperature stage circuit for circulation of a refrigerant including a compressor 11, an evaporator 14, an expansion valve 13, a cascade condenser/evaporator 22; and a high-temperature stage circuit for circulation of another refrigerant including a compressor 1, the cascade condenser/evaporator 22, an expansion valve 3 and a condenser 2, both circuits being interconnected in a heat exchangeable manner through the cascade condenser/evaporator 22, whereby a fluid to be heated can be discharged as a hot fluid from the condenser 2 and cold fluid can be discharged from the evaporator 14.

For the high-temperature stage circuit, a higher-boiling-point refrigerant such as 1,1,2-trichloro-1,2,2-trifluoroethane (flon R-113), s-dichlorotetrafluoroethane (flon R-114), trichlorofluoromethane (flon R-11), etc. may be used whereas for the low-temperature stage circuit, a lower-boiling-point refrigerant such as dichlorodifluoromethane (flon R-12), chlorodifluoromethane (flon R-22), etc. may be used.

In this manner, conventional refrigeration systems have been operated so as to ensure a certain amount of subcool degree in order to make the expansion valve operative without impairment, and the subcool degree necessitated to cause the expansion valve to act normally is currently considered to be as low as 3°-5° C. at the utmost. A superheat degree varies depending upon the kind of refrigerant, but usually is larger than a subcool degree.

Most condensers have each had a maximum heat transfer coefficient in the saturated refrigerant region and significantly lower heat transfer coefficients in the superheat and supercool regions, and consequently, no attempt to utilize heat transfer characteristics of supercool region has been made and considered. If it is intended to take advantage of supercool degree, the condenser to be used will be too large in size with the result that not only is its economic merit reduced, but also an increased pressure loss owing to the condenser of large size reduces the coefficient of performance. Of conventional heat exchangers for condensers, those of a shell and tube type, a parallel-flow type, a crossflow type, a circulation-counterflow type, a mixed flow type, etc. have been of no use since they cannot sufficiently cool the refrigerant.

Thus, the utilization of heat transmission characteristics of a supercool region has involved many obstacles and consequently, has never been taken into account or has been deemed impossible.

In view of the prior art problems above, this invention is aimed at providing a method of operating a heat pump with which it is possible to acquire a high-temperature fluid of 100° C. or more which is a high-quality fluid, such as steam (ca. 120°), boiling water (ca. 100°C.), etc. as well as relatively high-temperature water of 70°-100° C. More specifically, a primary object of this invention is to provide a method of operating a heat pump which enables it to discharge a high-temperature output fluid, with a maximal fluid temperature difference between the output and input temperatures being 80°-100° C. To that end, the invention is designed to realize the foregoing object through a single condenser without using a large-size condenser or mutliple condensers.

With a view toward attaining the object, the invention has taken a theoretical approach by newly considering the factor of a temperature effectiveness of refrigerant, which gives a measure of supercool degree, as defined by the formula:

$$\text{temperature effectiveness of liquid refrigerant} = \frac{\text{supercool degree } (=\text{saturated temp.} - \text{outlet temp. of refrigerant})}{\text{saturated refrigerant temp.} - \text{inlet temp. of fluid to be heated}}$$

We have investigated into the possibility of attaining efficiently an optimal high supercool degree that is much higher than ever while making the temperature difference between the saturated refrigerant temperature and inlet temperature of the fluid to be heated as large as possible and into requisites of a condenser that permit such a high supercool degree. As a result, the invention has been accomplished by finding a heat pumping method of utilizing efficiently a supercool region of a condenser, whereby it is possible to discharge a high-quality high-temperature fluid.

BRIEF DESCRIPTION OF THE INVENTION

This invention resides in a method of operating a heat pump having at least one circuit including a compressor, a condenser as a high-temperature heat output means, an expansion valve and a low-temperature heat output means interconnected for circulation of a refrigerant, which method comprises using, as the condenser, a heat exchanger of a complete counterflow, once-through path type to a fluid to be heated; said condenser having concentrical double tubes; and choosing a supercool degree, which is equal to the difference between a saturated refrigerant temperature and an outlet temperature of refrigerant, to satisfy the conditions that a temperrature effectiveness of refrigerant liquid defined by the formula:

$$\text{temperature effectiveness (of liq. refrigerant)} = \frac{\text{supercool degree}}{(\text{saturated refrigerant temp.} - \text{inlet temp. of fluid to be heated})}$$

is at least 40% and the temperature difference between saturated refrigerant temperature and inlet temperature of fluid to be heated is at least 35° C.

In the formula above, it is natural that the outlet temperature of refrigerant must be higher than the inlet temperature of fluid to be heated.

The aforementioned low temperature output means may be either an evaporator (single-circuit system), or a low-temperature segregated circuit including a compressor, an expansion valve, a cascade condenser-evaporator and an evaporator interconnected in a heat exchangeable manner with the high-temperature heat output circuit through the cascade condenser-evaporator (two circuit system) or multiple circuits having two or more segregated circuits (multiple-circuit system).

In gaining a highest possible temperature fluid or both high-temperature fluid and cold fluid, a two-circuit or multiple-circuit heat pump is preferably adopted. With a single-circuit heat pump, it is preferable to use a higher-boiling-point refrigerant. The once-through path, complete counterflow type condenser to be employed in this invention is formed of a concentrical double-tube heat exchanger comprising an outer tube and an inner tube having corrugated wire fins, in which fluid to be heated is routed through the inner tube in an once-through path and refrigerant is routed through between the inner and outer tubes in a counterflow manner to the former.

The fluid to be heated includes, for example, water of 0°-30° C., waste heat (up to 40° C.), etc.

According to the operation method of this invention, owing to the measure of choosing a supercool degree, it is easy to set and control the operational conditions of a condenser with different kinds of refrigerants. That is, it is possible to choose an optimal high supercool degree determined by the conditions above for an intended or desired high temperature of output fluid thereby to discharge a high-temperature fluid of approximately 100° C. or more, e.g. boiling water (ca. 100° C.) or steam (ca. 120° C.), and relatively high temperature water of 70°-100° C., etc. with a large temperature difference of 80°-100° C. at maximum to 50° C., while attaining a high coefficient of performance.

DETAILED DESCRIPTION OF PREFERRED EMBODIMENTS

The invention will be hereinbelow described in more detail by way of preferred embodiments with reference to the accompanying drawings.

The method of this invention can be performed with a single-circuit heat pump, or a two-circuit or multiple-circuit heat pump, depending upon the kind of refrigerant used.

Figure 1A:
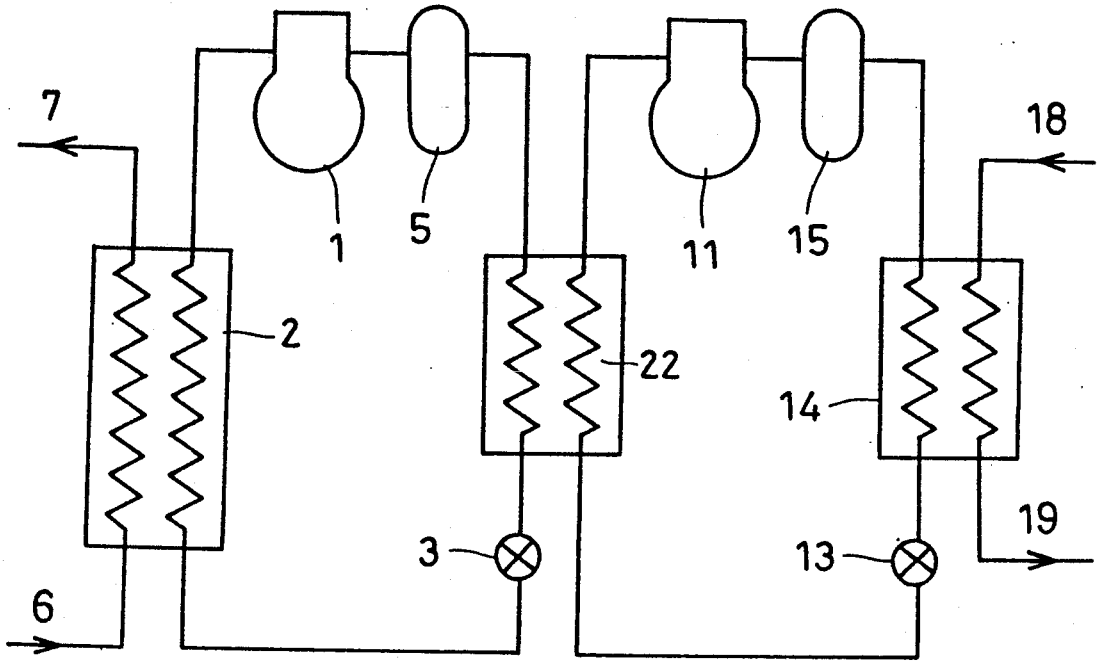
FIG. 1*a* nd FIG. 1*b* are diagrammatic layout views of a two-circuit heat pump and a single-circuit heat pump, respectively, with which the method of this invention can be performed.

For instance, a two-circuit heat pump as shown in FIG. 1*a* can be used, which comprises a low temperature stage circuit for circulation of a lower-boiling-point refrigerant including an evaporator 14 having a once-through path for a fluid to be cooled, an accumulator 15, a compressor 11, a cascade condenser-evaporator 22 and an expansion valve 13 connected in the order mentioned; and a high-temperature stage circuit for circulation of a higher-boiling-point refrigerant including the cascade condenser-evaporator 22, an accumulator 5, a compressor 1, a complete counterflow type condenser 2 having once-through path for fluid to be heated and an expansion valve 3 connected in the order mentioned, whereby two segregated circuits are interconnected through the cascade condenser-evaporator 22 in a heat exchangeable manner.

Figure 1B:
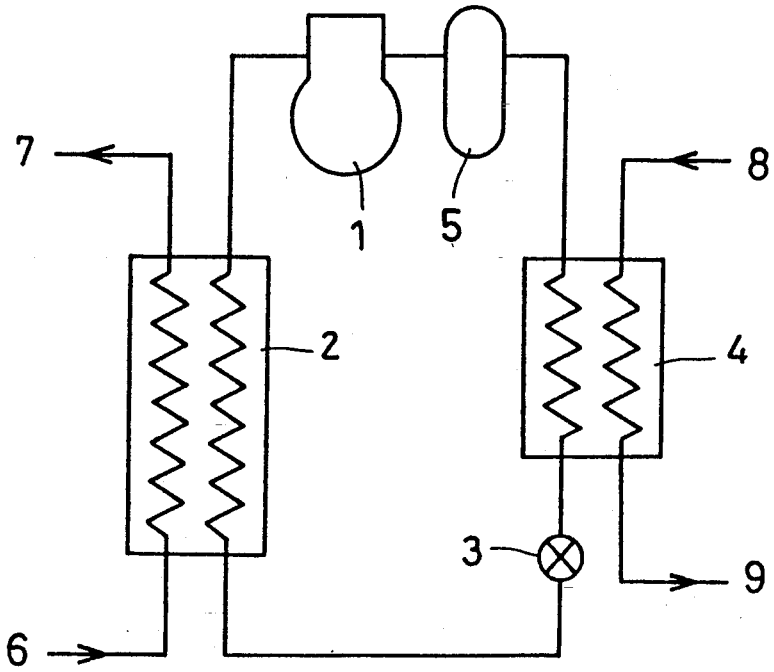

A single-circuit heat pump that can be also used for this invention comprises, as shown in FIG. 1*b*, an evaporator 4, an accumulator 5, a compressor 1, a complete counterflow type condenser 2 having a once-through path for fluid to be heated and an expansion valve 3 interconnected for circulation of a refrigerant.

Figure 2A:
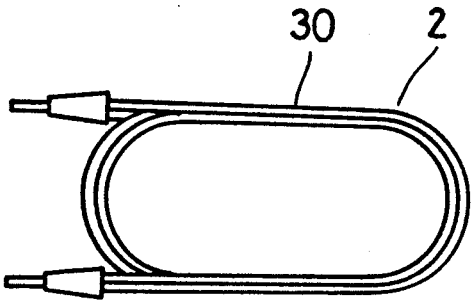
FIG. 2*a*, FIG. 2*b* and FIG. 2*c* are a plan view, a side elevational view and a fragmentary enlarged view, respectively, of one example of a concentrical double-tube condenser for use in the heat pumping method of the invention.
Figure 2B:
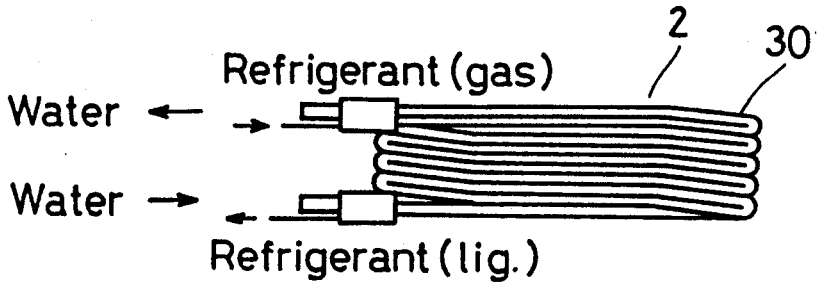
Figure 2C:
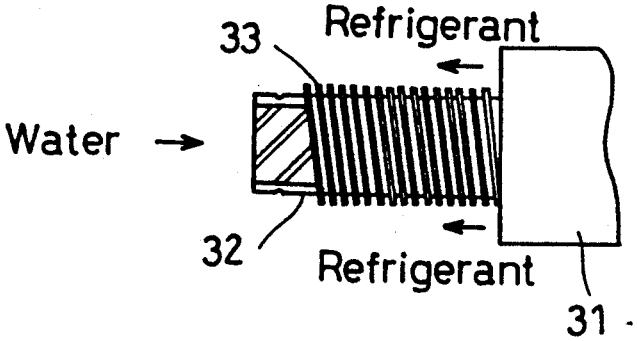

In either case, it is essential to this invention that the fluid to be heated be routed through the condenser 2 from an inlet 6 to an outlet 7 thereof in once-through path, in complete counterflow to the refrigerant flow. To that end, the condenser 2 is, as illustrated in FIGS. 2*a* to 2*c*, constructed of a concentrical double-tube 30 comprising an outer tube 31 and a corrugated inner tube 32 having wire fins 33.

Figure 3A:
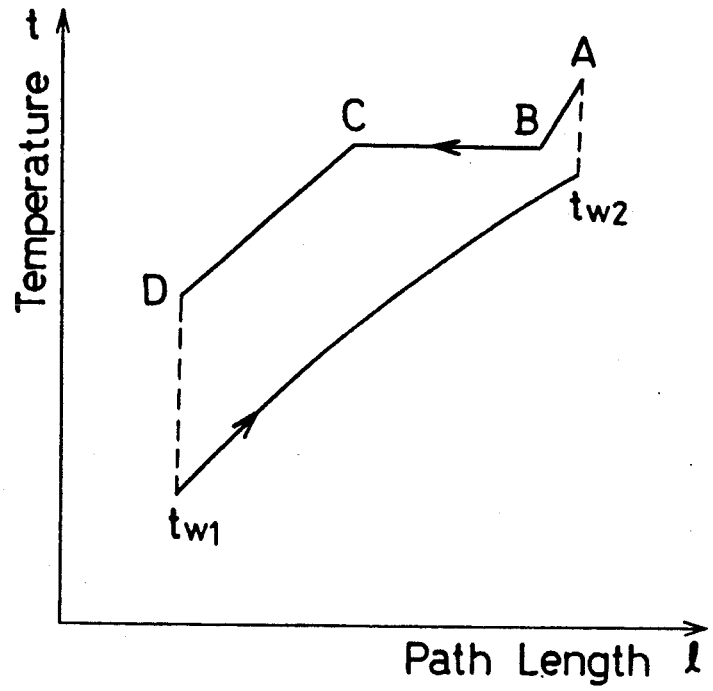
FIG. 3*a* and 3*b* are a diagram of heat interchange in a condenser and a Mollier diagram, respectively, obtained by one example of this invention applied to a two-circuit heat pump.
Figure 3B:
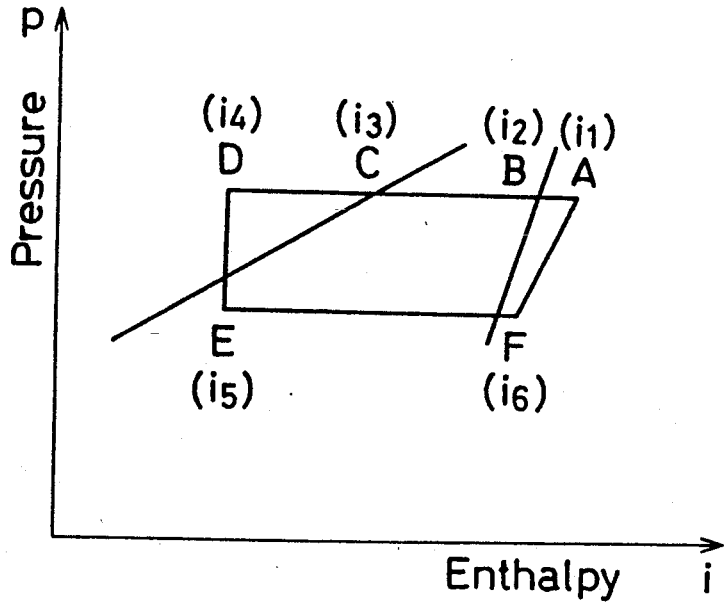
Figure 4A:
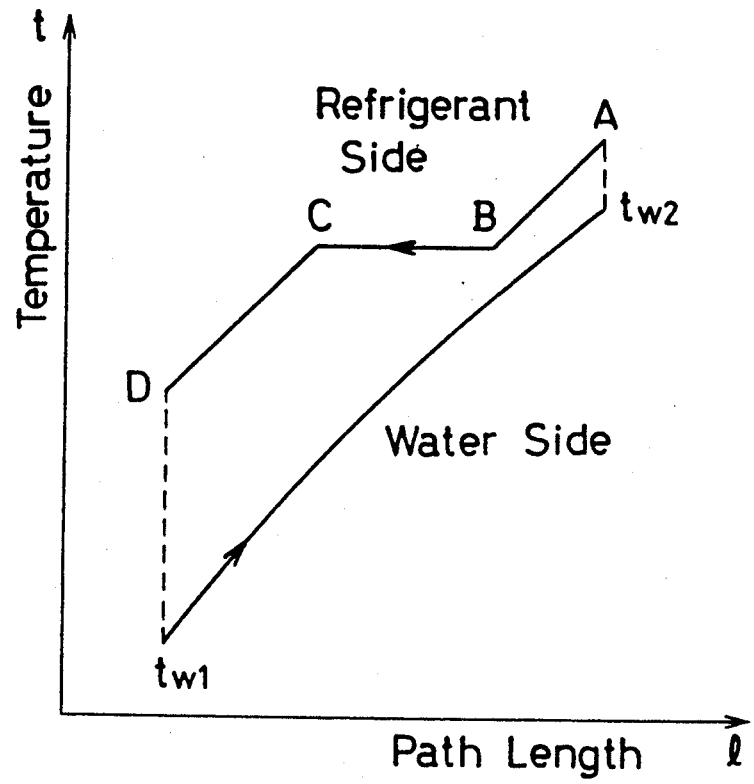
FIG. 4*a* and FIG. 4*b* are diagrams similar to FIGS. 3*a* and 3*b* resulting from another example of this invention applied to a single-circuit heat pump, FIG. 4*a* being a diagram of heat interchange in its condenser and FIG. 4*b* being a Mollier diagram.
Figure 4B:
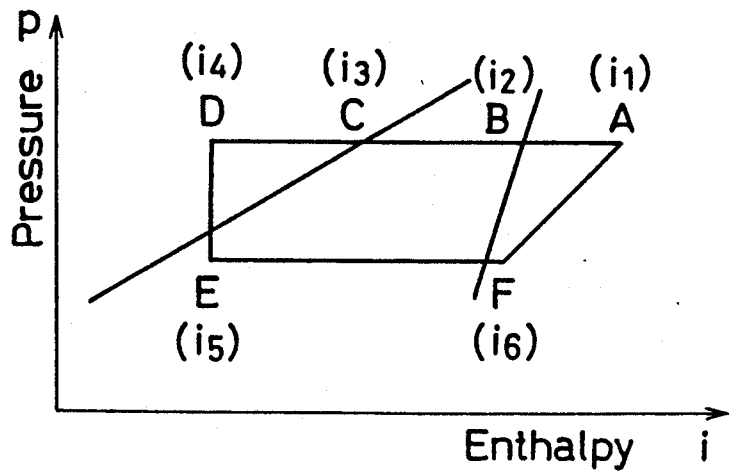

Examples of the heat pump cycle resulted from this invention, particularly, the process of change of state of the refrigerant (on the high-temperature circuit side) can be seen from Mollier diagrams of FIG. 3*b* and FIG. 4*b* whereas temperature gradients of both fluids in the condenser are apparent from FIG. 3*a* and FIG. 4*a*.

The refrigerant in superheat state (A) delivered from the compressor 1 to the inlet of the condenser 2 becomes saturated gas (B) during which time the enthalpy is changed from $i_1$ to $i_2$; the gas refrigerant is, upon cooling by water (fluid to be heated), liquefied and condensed at a constant pressure to be saturated liquid (C), during which time the enthalpy is changed to $i_3$; the liquid refrigerant is supercooled (D) at the outlet 7 of the condenser 2, reaching an enthalpy of $i_4$. Then, the refrigerant is subjected to throttling expansion (D to E) through the expansion valve 3 to flow into the cascade condenser-evaporator 22 or evaporator at in the same enthalpy of $i_4=i_5$; and there, the refrigerant is evaporated completely (E to F) at a lower pressure during which time the enthalpy is changed to $i_6$. The refrigerant having an enthalpy of $i_6$ is then sucked into the compressor 1, and a heat pump cycle is thus formed.

Figure 5A:
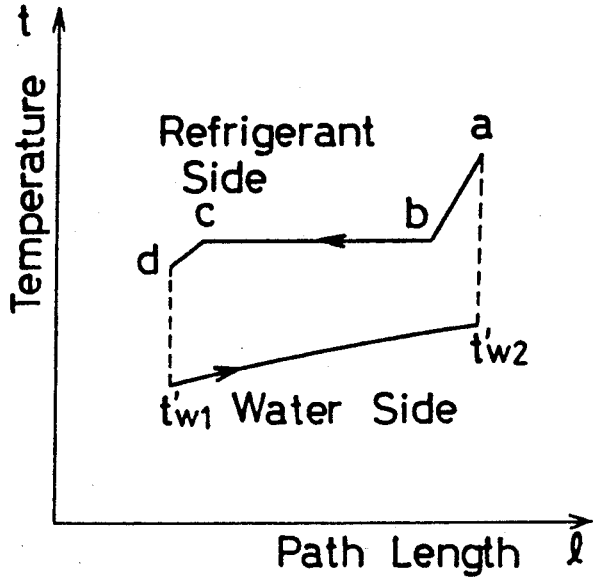
Fig. 5a PRIOR ART
FIG. 5*a* and FIG. 5*b* are diagrams resulted from a conventional heat pumping method, FIG. 5*a* being a diagram of heat interchange in a condenser and FIG. 5*b* being a Mollier diagram.

From the comparison between FIG. 3 or FIG. 4 (this invention) and FIG. 5 (prior art), it will be apparent that a significantly large supercool degree (C to D) and a significantly large temperature gradient of water between the outlet ($t_{w2}$) and inlet ($t_{w1}$) of the condenser 2 are obtained as compared with the case of conventional heat pump.

In the case of a two-circuit heat pump, fluid to be cooled supplied from an inlet 8 of the evaporator 4 is preferably routed through the evaporator in counterflow to the refrigerant flow; and the higher-boiling point refrigerant and lower-boiling-point refrigerant are preferably flowed through the cascade condenser-evaporator 22 in counterflow manner.

Examples of this invention will be shown below.

EXAMPLE 1

Two-stage heat pump installation as illustrated in FIG. 1*a* was operated by the use of a condenser having a double-tube construction shown in Table 1 below, water as both fluids and flon R-114 and R-22 as refrigerants for high-temperature and low-temperature stages, respectively, under the conditions given in Table 2 below. Physical data are also shown in Table 2.

TABLE 1

| Heat Transfer Tube | Wire Fin Corrugated Tube |
|---|---|
| Outer Tube (Diameter) | $25.4^{OD} \times {}^{t}1.2 \times 23.0^{ID}$ mm |
| Inner Tube (Diameter) | $12.7^{OD} \times {}^{t}1.7 \times 11.3^{ID}$ mm |
| Length | 3634 m |
| Heat Transfer Area | 0.154 $m^2$ |
| Corrugation Pitch and Depth | 4.67 mm; 0.21 mm |
| Height and Pitch of Wire Fins | 0.8 mm; 0.48 mm |

TABLE 2

| | Condenser | | |
|---|---|---|---|
| | Superheat Region | Saturation Region | Supercool Region |
| Heat Exchanger Duty*(kcal/h) | | 9552 | |
| Condenser Inlet Temp. of Water (°C.) | | 19.1 | |
| Condenser Outlet Temp. of Water (°C.) | | 98.7 | |
| Condenser Outlet Temp. of Refrigerant (°C.) | | 59.5 | |
| Saturation Temp. of Refrigerant (°C.) | | 112 | |
| Superheat Degree (°C.) | | 7.1 | |
| Supercool Degree** (°C.) | | 52.5 | |
| Flow Rate of Water (liter/h) | | 120 | |
| Flow Rate of Refrigerant (kg/h) | | 275.3 | |
| Quantity of Heat (kcal/h) | 496 | 5122 | 3937 |
| Overall Heat Transfer Coefficient (kcal/$m^2$h °C.) | 1131 | 3260 | 1246 |
| Heat Transfer Coefficient on the Refrigerant Side(kcal/$m^2$h °C.) | 1449 | 10859 | 1929 |
| Heat Transfer Coefficient on the Water side (kcal/$m^2$h °C.) | 5671 | 5124 | 3873 |
| Percentage of Heat Transfer Area (%) | 17.4 | 34.1 | 48.5 |

Notes:
*Heat Exchanger Duty = Flow Rate of Water × (Outlet Temp. of Water − Inlet Temp. of Water)
Supercool Degree = Saturation Temp. of Refrigerant − Outlet Temp. of Refrigerant Pressures and temperatures in the change of state of the refrigerant (R-114) in the high-temperature cycle were measured, and enthalpy values as plotted in the Mollier diagram of FIG. 3***b* were obtained. The results are shown in Table 3 below, in comparison with the case of conventional heat pump cycle.

TABLE 3

| | State | | | | | |
|---|---|---|---|---|---|---|
| This Invention | A | B | C | D | E | F |
| Temperature (°C.) | 119.1 | 112 | 112 | 59.5 | 35 | 78 |
| Pressure (kgf/$cm^2$) | 18.2 | 18.2 | 18.2 | 18.2 | 3.0 | 3.0 |
| Enthalpy (kcal/kg) | $i_1$ 148.8 | $i_2$ 147.0 | $i_3$ 128.4 | $i_4$ 114.1 | $i_5$ 114.1 | $i_6$ 145.4 |
| | State | | | | | |
| Conventional | a | b | c | d | e | f |
| Temperature (°C.) | 119.1 | 112 | 112 | 107 | 35 | 78 |
| Pressure (kgf/$cm^2$) | 18.2 | 18.2 | 18.2 | 18.2 | 3.0 | 3.0 |
| Enthalpy (kcal/kg) | $i'_1$ 148.8 | $i'_2$ 147.0 | $i'_3$ 128.4 | $i'_4$ 127.1 | $i'_5$ 127.1 | $i'_6$ 145.4 |

Notes:
The symbols of "A" to "F" and "a" to "f" correspond to the Mollier diagrams of FIG. 3b and FIG. 5b, respectively.
From Table 3 above, the following values are calculated.

| | Supercool Degree *1 | Temperature Effectiveness *2 | COP *3 |
|---|---|---|---|
| This Invention | 52.5° C. | 56.5% | 10.2 |
| Conventional | 5° C. | 5.4% | 6.4 |

TABLE 3-continued

Notes:

*1 Supercool Degree = $T_C - T_D$ or $T_c - T_d$

*2 Temperature Effectiveness = $\frac{T_C - T_D}{T_C - t_{w1}}$ or $\frac{T_c - T_d}{T_c - t'_{w1}}$

*3 Coefficient of Performance = $\frac{i_1 - i_4}{i_1 - i_6}$ or $\frac{i'_1 - i'_4}{i'_1 - i'_6}$ From Table 3, it will be apparent that the enthalpy difference of the refrigerant liquid upon subcooling is greater in this invention than in the conventional method.

Further, the relation between supercool degree of the refrigerant (R-114) in the condenser and coefficient of performance was examined, and the results obtained are given in Table 4 below.

The measurement conditions are as follows:

Saturation Pressure : 18.2 kgf/cm$^2$

Saturation Temperature ($T_C$) : 112.0° C.

Inlet Temperature of Water ($t_{w1}$) : 19.1° C.

Enthalpy at Compressor Inlet ($i_6$) : 145.4 kcal/kg

Enthalpy at Compressor Outlet ($i_1$) : 148.8 kcal/kg

TABLE 4

| Temperature Effectiveness *1 (%) | Supercool Degree *2 (°C.) | Outlet Temp. of Refrigerant Liq. $T_D$ (°C.) | Enthalpy of Refrigerant Liq. at Outlet $i_4$ (kcal/kg) | Coefficient of Performance *3 |
|---|---|---|---|---|
| 5 | 4.6 | 107.4 | 127.1 | 6.4 |
| 10 | 9.3 | 102.7 | 125.6 | 6.8 |
| 20 | 18.6 | 93.7 | 122.9 | 7.6 |
| 30 | 27.9 | 84.1 | 120.4 | 8.4 |
| 40 | 37.2 | 74.8 | 118.0 | 9.1 |
| 50 | 48.4 | 65.6 | 115.7 | 9.7 |
| 60 | 55.7 | 56.3 | 113.4 | 10.4 |
| 70 | 65.0 | 47.0 | 111.1 | 11.1 |
| 80 | 74.3 | 37.7 | 108.9 | 11.7 |

Notes:

*1 Temperature Effectiveness = $\frac{T_C - T_D}{T_C - t_{w1}} = \frac{112 - T_D}{92.9}$

*2 Supercool Degree = $T_C - T_D = 112 - T_D$

*3 Coefficient of Performance = $\frac{i_1 - i_4}{i_1 - i_6} = \frac{148.8 - i_4}{3.4}$ At the outlet of the condenser 2, boiling water of ca. 99° C. was discharged with a temperature difference of ca. 80° C. whereas at an outlet 19 of the evaporator 14, cold water of 7° C. was obtained with a temperature difference of 5° C.

EXAMPLE 2

A heat pump installation as shown in FIG. 1*b* was run by using dichlorofluoromethane (r-12) as refrigerant, a condenser of the construction shown in Table 5 below and water as both fluids, under the conditions in Table 6 below. The resulting data are also shown in Table 6.

TABLE 5

| Heat Transfer Tube | Wire Fin Corrugated Tube (Double-tube) |
|---|---|
| Outer Tube (Diameter) | $31.8^{OD} \times {}^{t}1.6 \times 30.2^{ID}$ mm |
| Inner Tube (Diameter) | $19.05^{OD} \times {}^{t}0.95 \times 17.15^{ID}$ mm |
| Length | 3520 m × 4 |
| Heat Transfer Area | 0.84 m$^2$ |
| Corrugation Pitch | 7.2 mm |
| Corrugation Depth | 0.31 mm |
| Height of Fins | 0.8 mm |
| Fin Pitch | 0.48 mm |

TABLE 6

| | Condenser | | |
|---|---|---|---|
| | Superheat Region | Saturation Region | Supercool Region |
| Heat Exchanger Duty(kcal/h) | | 13630 | |
| Condenser Inlet Temp. of Water (°C.) | | 20.4 | |
| Condenser Outlet Temp. of Water (°C.) | | 96.2 | |
| Saturation Temp. (°C.) | | 84.6 | |
| Superheat Degree (°C.) | | 50.6 | |
| Supercool Degree (°C.) | | 46.6 | |
| Flow Rate of Water (liter/h) | | 180 | |
| Flow Rate of Refrigerant (kg/h) | | 303.9 | |
| Quantity of Heat (kcal/h) | 3370 | 6470 | 3790 |
| Difference between Outlet Temp. and Inlet Temp. of Water(°C.) | 18.7 | 36.0 | 21.1 |

The temperature gradient and Mollier diagram of this heat pump cycle are diagrammatically shown in FIG. 4*a* and FIG. 4*b*, respectively.

Figure 5B:
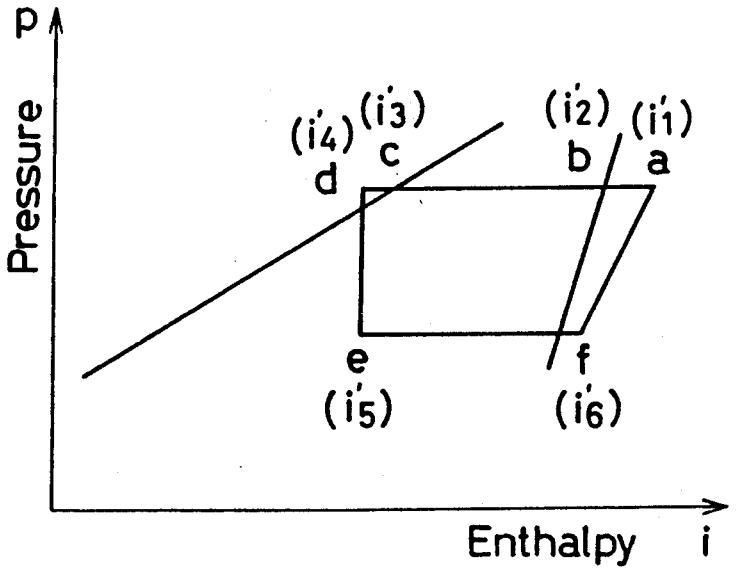
Fig. 5b PRIOR ART

Properties of R-12 refrigerant in the heat pump cycle presenting the Mollier diagram of FIG. 4*b* are given in Table 7 in comparison with the case of conventional heat pump cycle presenting the Mollier diagram of FIG. 5*b*.

TABLE 7

| This Invention | State A | B | C | D | E | F |
|---|---|---|---|---|---|---|
| Temperature °C. | 135.2 | 84.6 | 84.6 | 38.0 | 0.49 | 30.1 |
| Pressure kgf/cm2 | 25.6 | 25.6 | 25.6 | 25.6 | 3.2 | 3.2 |
| Enthalpy kcal/kg | $i_1$ 153.8 | $i_2$ 142.7 | $i_3$ 121.4 | $i_4$ 108.9 | $i_5$ 108.9 | $i_6$ 141.0 |

| Conventional | State a | b | c | d | e | f |
|---|---|---|---|---|---|---|
| Temperature °C. | 135.2 | 84.6 | 84.6 | 79.6 | 0.49 | 30.1 |
| Pressure kgf/cm2 | 25.6 | 25.6 | 25.6 | 25.6 | 3.2 | 3.2 |
| Enthalpy kcal/kg | $i'_1$ 153.8 | $i'_2$ 142.7 | $i'_3$ 121.4 | $i'_4$ 119.9 | $i'_5$ 119.9 | $i'_6$ 141.0 |

Notes:

The symbols A to F designate the states of FIG. 4b whereas the symbols a to f designate corresponding states of FIG. 5b.

From Table 7 above, the following values of performances are calculated.

| | Supercool Degree | Temperature Effectiveness | COP |
|---|---|---|---|
| This Invention | 46.6° C. | 72.6% | 3.5 |
| Conventional | 5° C. | 7.8% | 2.6 |

in this way, hot water of ca. 96° C. discharged with a temperature difference of ca. 76° C.

Thus far described, this invention provides a method of operating a heat pump with which it is possible to utilize effectively the supercool degree by the use of a once-through path, complete counterflow type condenser. As a consequence, a high-temperature water of 70°-100° C. or more or other high-temperature fluids can be discharged with a large temperature difference of 50°-100° C.

What is claimed is:

1. A method for operating a heat pump having at least one circuit for circulation of a refrigerant, said circuit comprising a compressor, a condenser as a high-temperature heat output means, an expansion valve and a low-temperature heat output means, said method comprising the steps of employing, as the condenser, a counterflow heat exchanger having a once-through flow path and a concentrical double-tube structure, passing a fluid to be heated and a refrigerant to be cooled through the condenser in absolute countercurrent flow with each other, withdrawing a heated fluid and a cooled refrigerant from the condenser and operating said condenser to obtain a supercool degree such that the following relationship is satisfied:

$$0.4 \leqq \frac{\text{supercool degree}}{\text{saturated refrigerant temperature} - \text{inlet temperature of fluid to be heated}}$$

wherein supercool degree is defined as the temperature difference between the saturated refrigerant temperature and the outlet temperature of the refrigerant and temperature difference between the saturated refrigerant temperature and the inlet temperature of the fluid to be heated is greater than or equal to 35° C., thereby enabling a high temperature hot fluid to be discharged with a large temperature difference from its inlet temperature.

2. The method as set forth in claim 1, wherein said low-temperature heat output means is an evaporator.

3. The method as set forth in claim 1, wherein said low-temperature heat output means is a low-temperature stage.

4. The method as set forth in claim 1, wherein said supercool degree is chosen to be more than 45° C. and said fluid to be heated is water which is discharged as hot water at a temperature which is higher by at least 80° C. than the inlet temperature thereof.

* * * * *

UNITED STATES PATENT AND TRADEMARK OFFICE

CERTIFICATE OF CORRECTION

PATENT NO. : 5 241 829

DATED : September 7, 1993

INVENTOR(S) : Toshimasa IRIE et al

It is certified that error appears in the above-identified patent and that said Letters Patent is hereby corrected as shown below:

Column 9, line 16; after "and" (second occurrence) insert ---the---.

Column 10, line 10; after "stage" insert ---circuit for circulation of a different refrigerant having a lower boiling point, said low-temperature stage circuit, comprising a compressor, an expansion valve, a cascade condenser-evaporator and an evaporator and being connected through the cascade condenser-evaporator to said circuit on the condenser side in a heat exchangeable manner.---.

Signed and Sealed this

Nineteenth Day of April, 1994

Bruce Lehman

*Attest:*

BRUCE LEHMAN

*Attesting Officer*

*Commissioner of Patents and Trademarks*